United States Patent [19]

Mitchell

[11] Patent Number: 4,663,264

[45] Date of Patent: May 5, 1987

[54] LIQUID ELECTROSTATIC DEVELOPERS CONTAINING AROMATIC HYDROCARBONS

[75] Inventor: Robert D. Mitchell, Wilmington, Del.

[73] Assignee: E. I. Du Pont de Nemours and Company, Wilmington, Del.

[21] Appl. No.: 856,393

[22] Filed: Apr. 28, 1986

[51] Int. Cl.[4] ..... G03G 9/12

[52] U.S. Cl. ..... 430/115; 106/20; 106/23; 106/32

[58] Field of Search ..... 430/115; 106/20, 23, 106/32

[56] References Cited

U.S. PATENT DOCUMENTS

| | | | |
|---|---|---|---|
| 3,032,432 | 5/1962 | Metcalfe et al. | 430/115 |
| 3,296,140 | 1/1967 | Zabiak . | |
| 3,505,231 | 4/1970 | Oliphant . | |
| 3,507,794 | 4/1970 | Fauser et al. . | |
| 3,522,181 | 7/1970 | Garrett et al. | 430/115 X |
| 3,535,244 | 10/1970 | Zabiak . | |
| 3,640,751 | 2/1972 | Kasuya et al. . | |
| 3,703,400 | 11/1972 | Tamai et al. . | |

FOREIGN PATENT DOCUMENTS

| | | | |
|---|---|---|---|
| 1030000 | 4/1974 | Canada . | |
| 2003620 | 3/1979 | United Kingdom | 430/115 |

*Primary Examiner*—Roland E. Martin

[57] ABSTRACT

Liquid electrostatic developer having improved charging characteristics consisting essentially of (A) nonpolar liquid having a Kauri-butanol value of less than 30, (B) thermoplastic resin particles substantially nonsoluble in nonpolar liquid and aromatic hydrocarbon at ambient temperature and having an average by area particle size of less than 10 $\mu$m, (C) nonpolar liquid soluble ionic or zwitterionic compound, and (D) aromatic hydrocarbon having a Kauri-butanol value of greater than 30.

The electrostatic liquid developers are useful in copying, making proofs including digital color proofs, lithographic printing plates, and resists.

15 Claims, No Drawings

LIQUID ELECTROSTATIC DEVELOPERS CONTAINING AROMATIC HYDROCARBONS

DESCRIPTION

1. Technical Field

This invention relates to a liquid electrostatic developer having improved charging characteristics. More particularly this invention relates to a liquid electrostatic developer containing as a constituent an aromatic hydrocarbon having a Kauri-butanol value of greater than 30.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 $\mu$m average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound to the liquid toner comprising the thermoplastic resin, dispersant nonpolar liquid and generally a colorant. Such liquid toners, while developing good quality images, still do not provide the quality images required for certain end uses, e.g., optimum machine performance in digital color proofing. As a result much research effort has been expended in providing new type charge directors and/or charging adjuvants for electrostatic liquid toners. Higher quality image development of latent electrostatic images is still desired.

It has been found that the above disadvantages can be overcome and improved liquid electrostatic developers prepared containing an ionic or zwitterionic compound soluble in nonpolar liquid and adjuvant which give higher particle mediated conductivity and/or improved image quality on latent electrostatic images.

DISCLOSURE OF THE INVENTION

In accordance with this invention there is provided a liquid electrostatic developer having improved charging characteristics consisting essentially of (A) nonpolar liquid having a Kauri-butanol value of less than 30, (B) thermoplastic resin particles substantially nonsoluble in nonpolar liquid and aromatic hydrocarbon at ambient temperature and having an average by area particle size of less than 10 $\mu$m.

(C) nonpolar liquid soluble ionic or zwitterionic compound, and (D) aromatic hydrocarbon having a Kauri-butanol value of greater than 30.

Throughout the specification the below-listed terms having the following meanings:

Particle mediated conductivity is the difference between the bulk conductivity of the toner and the conductivity of the solution, e.g., carrier or nonpolar liquid.

Bulk conductivity is the conductivity of the developer and may be expressed as BULK.

Conductivity of the solution means the conductivity of the supernatant remaining after centrifugation and may be expressed as SOLN.

Conductivity attributed to the particles is the difference between the bulk conductivity and the conductivity of the solution (BULK-SOLN) and may be expressed as PART.

The electrostatic liquid developer, as defined above consists essentially of the four components more specifically described below. The term "consisting essentially of" means the composition of the electrostatic liquid developer does not exclude unspecified materials which do not prevent the advantages of the developer from being realized. Additional components, in addition to the four primary components, include but are not limited to: colorants such as pigments or dyes, which are preferably present, fine particle size oxides, metals, etc.

The dispersant nonpolar liquids (A) are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C., Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar®-L and Isopar®-M have flash points of 61° C., and 80° C., respectively, determined by the same method. While these are preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

Useful thermoplastic resins or polymers which are in the form of particles include: ethylene vinyl acetate (EVA) copolymers (Elvax® resins, E. I. du Pont de Nemours and Company, Wilmington, DE), copolymers of ethylene and an $\alpha,\beta$-ethylenically unsaturated acid selected from the class consisting of acrylic acid and methacrylic acid, copolymers of ethylene (80 to 99.9%) acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite®DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, DE, etc. Preferred copolymers are the copolymer of ethylene and an $\alpha,\beta$-ethylenically unsaturated acid of either acrylic acid or methacrylic acid. The synthesis of copolymer of this type are described in Rees U.S. Pat. No. 3,264,272, the disclosure of which is incorporated herein by reference. For the purposes of preparing the preferred copolymers, the reaction of the acid containing copolymers with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the resins have the following preferred characteristics:

1. Be able to disperse the colorant, e.g., pigment,
2. Be insoluble in the dispersant liquid at temperatures below 40° C., so that the resin will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become swollen or gelatinous.

Suitable nonpolar liquid soluble ionic or zwitterionic compounds (C) include those compounds known in the art as agents that control the polarity of the charge on toner particles (charge directors). Examples of such compounds, which are generally used in an amount of 1 to 100 mg/g developer solids, are positive charge directors, e.g., sodium dioctylsulfosuccinate (manufactured by American Cyanamid Co.), zirconium octoate and metal soaps such as copper oleate, etc.; negative charge directors, e.g., lecithin, Basic Calcium Petronate®, Basic Barium Petronate® oil-soluble petroleum sulfonate, manufactured by Sonneborn Division of Witco Chemical Corp., New York, NY, alkyl succinimide (manufactured by Chevron Chemical Company of California), etc.

The fourth component of the liquid electrostatic developer is (D) an aromatic hydrocarbon having a Kauri-butanol value of greater than 30, determined by ASTM D 1133. Examples of this type of hydrocarbon compound include: benzene, toluene, naphthalene, substituted benzene and naphthalene compounds, e.g., trimethylbenzene, xylene, dimethylethylbenzene ethylmethylbenzene, propylbenzene, Aromatic 100 which is a mixture of $C_9$ and $C_{10}$ alkyl-substituted benzenes, manufactured by Exxon Corp., etc. The bulk conductivity which has proven particularly useful is in the range of about 1 to 80 pmho/cm.

The components are present in the liquid electrostatic developer in the indicated amounts.

Component A: 0.14 to 99.6% by weight, preferably 79.65 to 97.7% by weight;

Component B: 0.25 to 15.0% by weight,

Component C: 0.01 to 1.0% by weight, preferably 0.1 to 0.2% by weight; and

Component D: 0.14 to 99.6% by weight, preferably 1.95 to 20.0% by weight, all weights are based on the total weight of the developer.

As indicated above, additional components that can be present in the liquid electrostatic developer are colorants, such as pigments or dyes and combinations thereof, are preferably present to render the latent image visible, though this need not be done in some applications. The colorant, e.g., a pigment, may be present in the amount of up to about 60 percent by weight or more based on the weight of the resin. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Stirling NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

The percent pigment in the thermoplastic resin is 1% to 50% by weight preferably 1 to 30% by weight.

The particles in the liquid electrostatic developer have an average by area particle size of less than 10 μm, preferably the average by area particle size is less than 5 μm. The resin particles of the developer may or may not be formed having a plurality of fibers integrally extending therefrom although the formation of fibres extending from the toner particles is preferred. The term "fibers" as used herein means pigmented toner particles formed with fibers, tendrils, tentacles, threadlets, fibrils, ligaments, hairs, bristles, or the like.

The liquid electrostatic developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media for dispersing and grinding, Ross double planetary mixer manufactured by Charles Ross and Son, Hauppauge, NY, etc., are placed the above-described ingredients. Generally the resin, dispersant nonpolar liquid and optional colorant are placed in the vessel prior to starting the dispersing step although after homogenizing the resin and the dispersant nonpolar liquid the colorant can be added. The dispersing step is generally accomplished at elevated temperature, i.e., the temperature of ingredients in the vessel being sufficient to plasticize and liquefy the resin but being below that at which the dispersant nonpolar liquid degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical cylindrical, etc. taken from the class consisting of stainless steel, alumina, ceramic, zirconium, silica, and sillimanite. Carbon steel particulate media is useful when colorants other than black are used. A typical diameter range for the particulate media is in the range of 0.04 to 0.5 inch (1.0 to ~13 mm).

After dispersing the ingredients in the vessel until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is conducted to reduce the concentration of toner particles to between 0.1 to 3 percent by weight, preferably 0.5 to 2 weight percent with respect to the dispersant nonpolar liquid. One or more nonpolar liquid soluble ionic or zwitterionic compounds, of the type set out above, can be added to impart a positive or negative charge, as desired. The addition may occur at any time during the process. If a diluting dispersant nonpolar liquid is also added, the ionic or zwitterionic compound can be added prior to, concurrently with, or subsequent thereto. A preferred mode of the invention is described in Example 1.

INDUSTRIAL APPLICABILITY

The liquid electrostatic developers of this invention demonstrate improved charging qualities over liquid developers containing standard charge directors or other known additives resulting in improved image quality. The toners have higher particle mediated conductivity than with previous toners and their transfer efficiency is improved. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image.

Other uses are envisioned for the liquid electrostatic developers include: digital color proofing, which requires toners having high particle mediated conductivity, lithographic printing plates, and resists.

EXAMPLES

The following controls and examples wherein the parts and percentages are by weight illustrate but do not limit the invention. In the examples the melt indices were determined by ASTM D 1238, Procedure A, and the average particle sizes by area were determined by a Horiba CAPA-500 centrifugal particle analyzer as described above.

CONTROL 1

In a Union Process 01 Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 30.0 |
| Mogul ® L carbon black C.I. Pigment 77266, Cabot Corp., Carbon Black Division, Boston, Mass. | 8.0 |
| Isopar ®-L, nonpolar liquid having a Kauri-butanol value of 27, Exxon | 125.0 |

-continued

| Ingredient | Amount (g) |
|---|---|
| Corporation | |

The ingredients were heated to 90° C.±10° C. and milled at a rotor speed of 230 rpm with 0.1875 inch (4.76 mm) diameter stainless steel balls for one hour. The attritor was cooled to room temperature while the milling was continued and then 125 grams of Isopar ®-H, nonpolar liquid having a Kauri-butanol value of 27, Exxon Corporation were added. Milling was continued and the average particle size by area was monitored. The particulate media were removed and the dispersion of toner particles was then diluted to 2 percent solids with additional Isopar ®-H and a charge director, 1.0 and 1.2 g Basic Barium Petronate ®, Sonneborn Division of Witco Chemical Corp., New York, N.Y., was added. Image quality was determined using a Savin 870 copier at standard mode: Charging corona 6.8 kv and transfer corona set at 8.0 kv using as carrier sheets Savin 2200 paper (Savin), and Plainwell offset enamel paper number 3 class 60 lb. test (offset). Conductivity results are shown in Table 1 below.

EXAMPLE 1

The procedure of Control 1 was repeated with the following exception: 125 grams of toluene were added in place of Isopar ®L. Results are shown in Table 1 below.

EXAMPLE 2

The procedure of Control 1 was repeated with the following exceptions: 125 grams of Aromatic 100, a high purity aromatic solvent having a Kauri-butanol value of 91, manufactured by Exxon Corporation, were added in place of Isopar ®-L and 125 grams of Aromatic 100 were used in place of Isopar ®-H. Dilution was done with Isopar ®-H. Results are shown in Table 1 below.

EXAMPLE 3

In a Union Process 01 Attritor, Union Process Company, Akron, Ohio, was placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Mogul ® L carbon black C.I. Pigment 77266, Cabot Corp., Carbon Black Division, Boston, Mass. | 67.0 |
| Aromatic 100, a high purity aromatic solvent having a Kauri-butanol value of 91, Exxon Corporation | 1000.0 |

The ingredients were heated to 90° C.±10° C. and milled at a rotor speed of 230 rpm with 0.1875 inch (4.76 mm) diameter stainless steel balls for one hour. The attritor was cooled to 42° C.±5° C. while the milling was continued and then 700 grams of Isopar ®-H, nonpolar liquid having a Kauri-butanol value of 27, Exxon Corporation were added. Milling was continued and the average particle size by area was monitored. The particulate media were removed and the dispersion of toner particles was then diluted to 2 percent solids by weight with additional Isopar ®-H and a charge director, 1.0 and 1.2 g. Basic Barium Petronate ®, described in Control 1, was added. Image quality was determined using a Savin 870 copier at standard mode described in Control 1. The carrier sheet was Savin 2200 paper (Savin), and Plainwell offset enamel paper number 3 class 60 lbs. test (offset). Conductivity results are shown in Table 1 below.

EXAMPLE 4

The procedure of Example 3 was repeated with the following exceptions: 25 grams of Dalamar ® Yellow YT-858D pigment, Pigment Yellow 74, Heubach, Inc., Newark, NJ, were added in place of Mogul ®L carbon black, at a resin/pigment ratio of 1:1; only 1.0 g of charge director was used. Results are shown in Table 1 below.

EXAMPLE 5

The procedure of Example 4 was repeated with the following exceptions: the resin to pigment ratio used was 10:1, only 1.2 g of charge director was used. Results are shown in Table 1 below.

TABLE 1

| EX. | PARCLE SIZE (μm) | AROMATIC ADDITIVE | CHARGE DIRECTOR (g) | CONDUCTIVITY[1] BULK | SOLN | PART |
|---|---|---|---|---|---|---|
| Control | 1.90 | None | 1.0 | 60 | 50 | 10 |
| | | | 1.2 | 74 | 60 | 14 |
| 1 | 1.40 | TOLUENE | 1.0 | 55 | 35 | 20 |
| | | | 1.2 | 85 | 65 | 20 |
| 2 | 1.90 | AROMATIC 100 | 1.0 | 39 | 28 | 21 |
| | | | 1.2 | 47 | 26 | 21 |
| 3 | 0.98 | AROMATIC 100 | 1.0 | 77 | 33 | 44 |
| | | | 1.2 | 110 | 55 | 55 |
| 4 | 0.89 | AROMATIC 100 | 1.0 | 90 | 60 | 30 |
| 5 | 1.80 | AROMATIC 100 | 1.2 | 95 | 65 | 30 |

[1]Conductivities are measured in picomhos(pmhos)/cm at 5 hertz and low voltage, 5.0 volts.

I claim:

1. A liquid electrostatic developer having improved charging characteristics consisting essentially of
   (A) nonpolar liquid having a Kauri-butanol value of less than 30,
   (B) thermoplastic resin particles substantially nonsoluble in nonpolar liquid and aromatic hydrocarbon at ambient temperature and having an average by area particle size of less than 10 μm,
   (C) nonpolar liquid soluble ionic or zwitterionic compound, and
   (D) aromatic hydrocarbon having a Kauri-butanol value of greater than 30.

2. A liquid electrostatic developer according to claim 1 wherein component (A) is present in 0.14 to 99.6% by weight, component (B) is present in 0.25 to 15.0% by weight, component (C) is present in 0.01 to 1.0% by weight, component (D) is present in 0.14 to 99.6% by weight, all weight percentages being based on the total weight of the developer.

3. A liquid electrostatic developer according to claim 1 wherein the aromatic hydrocarbon is toluene.

4. A liquid electrostatic developer according to claim 1 containing up to about 60% by weight of a colorant based on the weight of resin.

5. A liquid electrostatic developer according to claim 4 wherein the colorant is a pigment.

6. A liquid electrostatic developer according to claim 4 wherein the percent pigment in the thermoplastic resin is 1% to 50% by weight.

7. A liquid electrostatic developer according to claim 4 wherein the colorant is a dye.

8. A liquid electrostatic developer according to claim 1 wherein a fine particle size oxide is present.

9. A liquid electrostatic developer according to claim 1 wherein the thermoplastic resin is a copolymer of ethylene and an $\alpha,\beta$-ethylenically unsaturated acid selected from the group consisting of acrylic acid and methacrylic acid.

10. A liquid electrostatic developer according to claim 1 wherein the thermoplastic resin is an ethylene vinyl acetate copolymer.

11. A liquid electrostatic developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

12. A liquid electrostatic developer according to claim 9 wherein the thermoplastic resin is a copolymer of ethylene (89%)/methacrylic acid (11%) having a melt index at 190° C. of 100.

13. A liquid electrostatic developer according to claim 1 wherein the particles have an average by area particle size of less than 5 $\mu$m.

14. A liquid electrostatic developer according to claim 1 wherein component (C) is Basic Barium Petronate.

15. A liquid electrostatic developer according to claim 1 wherein component (C) is lecithin.

* * * * *